United States Patent [19]

Valenti

[11] Patent Number: 4,871,067

[45] Date of Patent: Oct. 3, 1989

[54] PERFECTED CASE FOR PACKAGING PRODUCTS OF DIFFERENT KINDS IN CASES

[75] Inventor: Dante Valenti, Imola, Italy

[73] Assignee: In-Pak S.p.A., Italy

[21] Appl. No.: 326,411

[22] Filed: Mar. 17, 1989

Related U.S. Application Data

[63] Continuation of Ser. No. 113,613, Oct. 26, 1987, abandoned.

[30] Foreign Application Priority Data

Oct. 30, 1986 [IT] Italy ..... 5040/86[U]

[51] Int. Cl.[4] ..... B65D 5/54

[52] U.S. Cl. ..... 206/427; 206/602; 206/624; 206/629; 229/164

[58] Field of Search ..... 229/164; 206/427, 429, 206/602, 611, 624, 629, 631, 634

[56] References Cited

U.S. PATENT DOCUMENTS

| | | | |
|---|---|---|---|
| 3,425,544 | 2/1969 | Ayer et al. | 229/164 |
| 3,784,082 | 1/1974 | Hurlock | 229/164 |
| 4,003,514 | 1/1977 | Graser | 206/631 |
| 4,263,769 | 4/1981 | Hanazawa et al. | 206/602 |
| 4,533,052 | 8/1985 | Fruchey et al. | 206/602 |
| 4,635,795 | 1/1987 | Deflander et al. | 206/631 |

FOREIGN PATENT DOCUMENTS

| | | | |
|---|---|---|---|
| 157742 | 10/1985 | European Pat. Off. | 206/427 |
| 0178717 | 4/1986 | European Pat. Off. . | |
| 0235852 | 2/1987 | European Pat. Off. . | |
| 2196273 | 3/1974 | France . | |
| 2498561 | 7/1982 | France . | |
| 382645 | 12/1964 | Switzerland . | |
| 1141676 | 1/1969 | United Kingdom | 206/611 |
| 2008542 | 6/1979 | United Kingdom | 206/611 |

*Primary Examiner*—Gary Elkins
*Attorney, Agent, or Firm*—Darby & Darby

[57] ABSTRACT

The case comprises a base piece, two side pieces, two head pieces, two strengthening projections located along the vertical edges of head pieces, two end flaps folding on the top ends of the head pieces and folded over the strengthening projections and a lid that is obtained from a single lid blank divided up by preformed fold lines and perforated lines, the latter permitting the partial or total removal of the lid from the case.

2 Claims, 2 Drawing Sheets

PERFECTED CASE FOR PACKAGING PRODUCTS OF DIFFERENT KINDS IN CASES

This is a continuation of application Ser. No. 113,613, filed Oct. 26, 1987 now abandoned.

BACKGROUND OF THE INVENTION

The present invention concerns a closed case for packaging articles of different kinds, featuring a lid that can be removed, permitting the products contained within to be seen from one or both sides.

The invention is specifically concerned with the final packing of the case once it has already been filled with the relevant products.

DESCRIPTION OF THE PRIOR ART

Cases known as the "VISUAL BOX" type are normally composed of a base piece, two side pieces and two head pieces, the latter are normally much higher than the side pieces.

The vertical edges of the head pieces feature vertical strengthening projections having, for example, a triangular cross-section.

The stiffening action of the strengthening projections enables the cases to be stacked on top of each other in piles making for convenient storage.

In order to protect the products contained in the cases from, for example, air-borne dust, the cases are wrapped in transparent synthetic materials known to technicians in the sector as heat-shrinking, which is to say thay contract when subjected to the action of heat.

An alternative to this costly and complex procedure involves fitting a suitably shaped lid to every case.

This lid must be easy to remove, so that the products contained in the case can be seen when they are put on sale to the public.

The lid blank for producing the lid comprises a central portion with two folding wings, one on either side, and is fitted to the case using automatic machines, the central portion being glued to end flaps on the head pieces, and resting on the strengthening projections.

The two inside edges of the free ends of the two wings are, on the other hand, glued to the corresponding areas on the upper edges of the side pieces of the case, marked out by perforated lines.

To see the products inside the case it is sufficient to tear off the area along the perforated lines, by using the wings, lifting them up.

In this way there are no unsightly glue marks or torn cardboard filaments on the outside surfaces of the side pieces, as there would be if one had to separate parts that had previously been glued together.

The most obvious disadvantage with this system for closing the cases is encountered when the filled and closed cases are stacked on top of one another.

The weight of the upper cases on top of the head pieces of the lower cases causes them to be compressed, this, due to the stiffening action they receive from the strengthening projections, resulting in notable and uniform shortening over their entire length.

Since the two wings of the lid are fixed to the case along the upper and lower horizontal edges, that is to say at points very close to the top and bottom of the case, they respond to the compression with an elastic action, bending outwards.

The disadvantages consequent upon the above are obvious: not only are the resultant gaps between the side pieces and wings of the case unsightly, but the fact that the latter bend outwards means that dust can enter the case, accumulating on the products within.

A further disadvantage is due to the fact that the central area of the lid remains attached to the end flaps, and, to fully display the contents of the case, the lid must be torn off, leaving glue marks or cardboard filaments visible.

SUMMARY OF THE INVENTION

The object of the present invention is to produce a case closed with a lid that can be easily removed without leaving unslightly traces of glue or cardboard filaments.

A further object of the invention is that the lid of the aforesaid case must remain perfectly glued to the side pieces of the latter, even following the stacking of several other cases above it.

A final object of the present invention is to produce cases fitted with related lids that can be more easily packed, stored, transported and sold wholesale than those cases at present in use, whilst at the same time retaining the practical convenience characterising small size packaging during subsequent retail sale.

The above objects are obtained through the production of a perfected case for products of different kinds, of the type comprising a base piece, two side pieces and two head pieces, two strengthening projections, located along the vertical edges of each of the said head pieces, and two end flaps, folding on the upper ends of the said head pieces, and folded over the said strengthening projections; the said case being characterised by the fact that it comprises a lid obtained from a single lid blank, divided by preformed transverse fold lines into a central area and two wings, that fold on the former and are located opposite each other, the said central area featuring the same number of perforated lines along its free edges, continuing along the contiguous edges of the said wings, delineating two strips, designed to be glued to the outer faces of the said strengthening projections by the respective portions which correspond to the said wings, and to be glued to the said end flaps by the respective strips corresponding to the above-mentioned central area, thus leaving the possibility, after the said lid has been fitted to the aforesaid case, of detaching the central area and wings from the corresponding aforementioned portions of the said strips along the perforated lines strips, this enabling the lid itself to be removed.

BRIEF DESCRIPTION OF THE DRAWINGS

The characteristics of the invention not to have emerged from that stated above, are emphasised hereinafter with specific reference to the attached tables of drawings in which.

DESCRIPTION OF THE PREFERRED EMBODIMENT

With reference to the above figures, 1 indicates a case of the type known as a "VISUAL BOX".

Figure 2A:
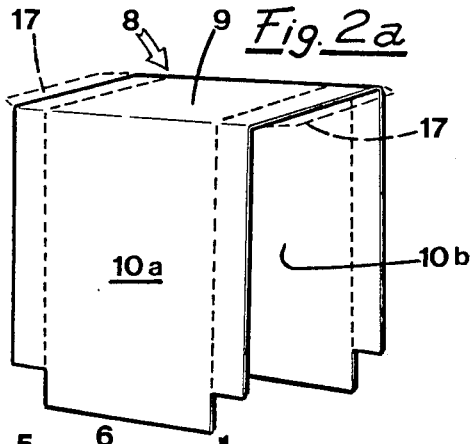
FIG. 2 is is a view in perspective of the lid made from the lid blank illustrated in FIG. 1.
FIG. 2*b* is a view in perspective of a case to which the lid in FIG. 2a is designed to be fitted.
FIG. 2*c* illustrates the top portion of a head piece in a variation on the case shown in FIG. 2*b;*
Figure 2B:
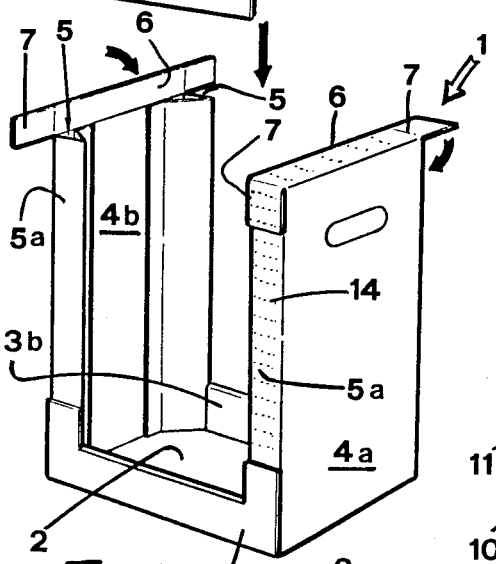

As shown in FIG. 2*b*, this case comprises a base piece 2, two side pieces 3*a* and 3*b*, and two head pieces 4*a* and 4*b*. Vertical strengthening projections 5 having, for example, a triangular cross-section, are produced along each of the vertical edges of the head pieces using known techniques so that their faces 5*a* face outwards.

The top edge of each head piece features an end flap 6 with two tabs 7 on either side of it.

The end flaps 6 are folded over the strengthening projections 5 and kept in this position by the tabs 7, which are also folded downwards and glued to the corresponding top portions of the faces 5*a* of the strengthening projections 5.

Figure 1:
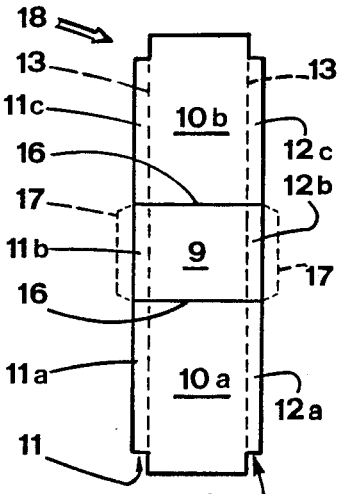
FIG. 1 is a plan of the lid blank.

FIG. 1 shows a lid blank for obtaining the lid 8 of the case.

The lid blank features two transverse fold lines 16 which delineate a central area 9, and two wings 10*a* and 10*b* which are located opposite each other on either side of it.

Two perforated lines 13 are produced close to the free ends of the central area 9, and are extended along the full length of the contiguous edges of each of the wings 10*a* and 10*b*.

In this way two strips 11 and 12 are delineated, divided by the fold lines 16 into central strips 11*b* and 12*b*, corresponding to the central zone 9, and lateral strips 11*a*, 12*a*, 11*c* and 12*c*, corresponding to wings 10*a* and 10*b*.

The ends of strips 11 and 12 are cut as required for the free ends of the wings to have an outline that corresponds and is complementary to the shape of the related upper edges of each side piece.

Figure 3:
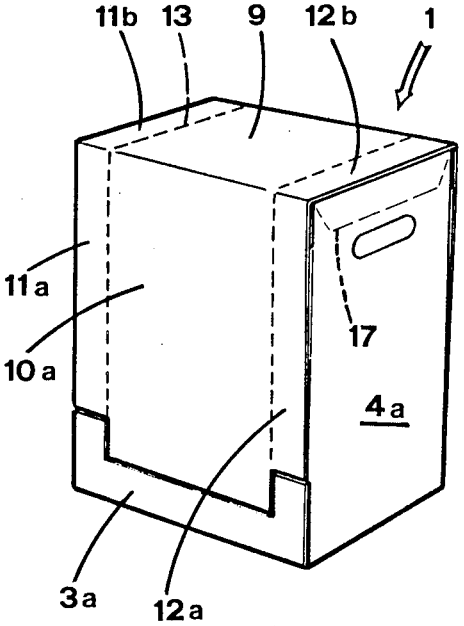
FIG. 3 shows a case to which a lid has been fitted.

The lid is fitted to the case by applying lines of glue 14 to the faces 5*a* of the strengthening projections 5 and on end flaps 6, then placing the central portions 11*b*, 12*b* of the lid 8 in contact with the end flaps, and the side portions 11*a*, 12*a*, 11*c* and 12*c* in contact with the relevant faces 5*a* as shown in FIG. 3.

The lid can be totally or partially removed (Fig. 4) using the central portion of the free end of one of the two wings, which can be easily bent and lifted up.

Figure 4:
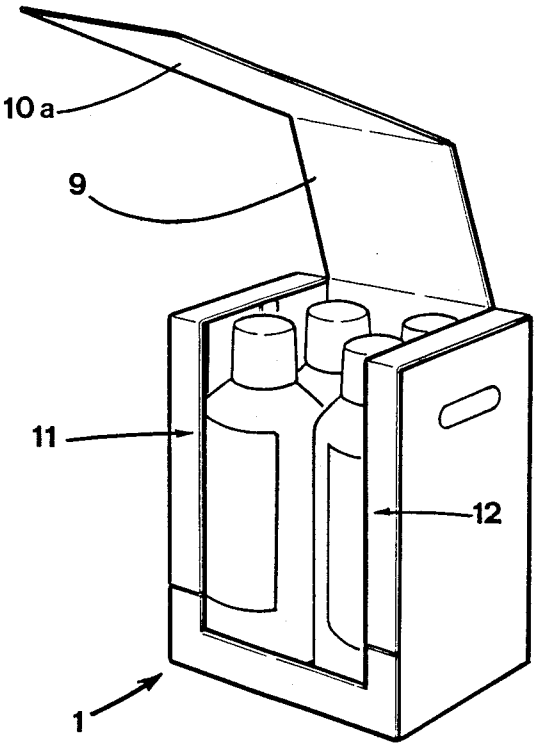
FIG. 4 shows a case with the lid partially removed.
Figure 6:
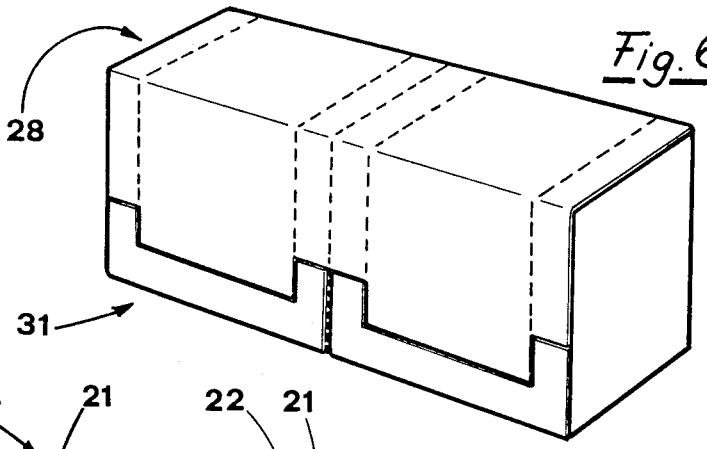
FIG. 6 shows two cases joined side by side using a lid obtained from a lid blank as illustrated in FIG. 5.
Figure 5:
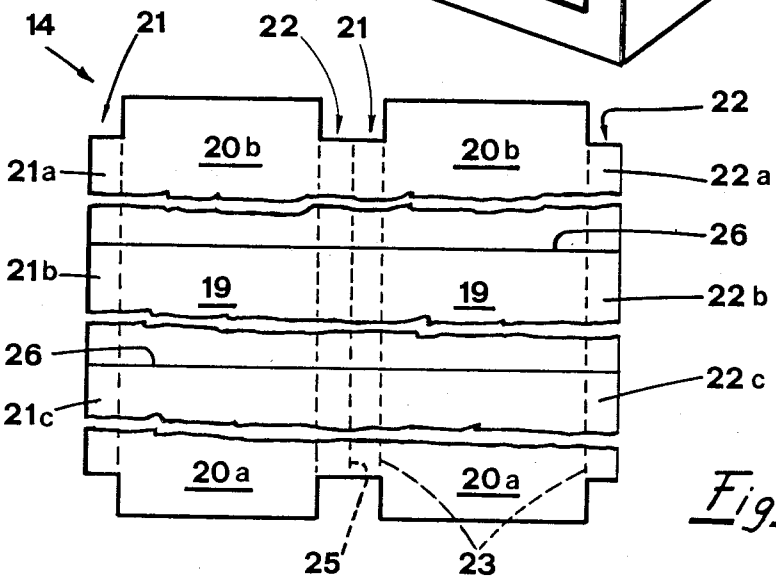
FIG. 5 shows a modified lid blank for obtaining two cases joined side by side.

The perforated lines enable the wings and lid to be neatly detached from strips 11 and 12, which remain fixed to the end flaps without any leaving any unsightly traces of glue or cardboard filaments as shown in FIG. 4.

Once the wing of a partially removed lid has been detached from strips 11 and 12 (see FIG. 4), it can, if desired, be bent back upon itself, and its free end inserted between the products contained in the case and the remaining wing, so that it is located behind and raised above the products themselves.

In this way the image shown on the outer surface of the wing itself remains clearly visible to the public, continuing to serve its function of advertising the products contained in the case, and supplying the purchaser with the relevant information.

Figure 2C:
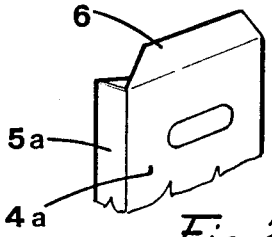

In another embodiment of the invention, the end pieces 6 of the case can be shaped as illustrated in FIG. 2*c*, without tabs 7.

This avoids there being any raised portions in the upper part of the faces 5*a* of the strengthening projections 5, thus enabling uniform adhesion of strips 11*a*, 12*a*, 11*c* and 12*c* to the faces themselves, and optimising the aesthetic appearance of the case as a whole.

It is obviously impossible for the middle areas of the wings 10*a* and 10*b* of a case made in this way to move away from the ideal plane defined by the faces 5*a*, by curving outwards from the case.

In this way one avoids the unsightly gaps which are inevitable when using lids of the type described in the introduction.

A further embodiment of the invention concerning the lid of the case, features additional tabs 17 which are located opposite one another on either side of the central area 9, shown by broken lines in FIGS. 1, 2*a* and 3, designed to be folded downwards when the lid has already been fitted to the case, and then glued to the corresponding top parts of the outer surfaces of the related head pieces 4*a* and 4*b*.

In addition to this, lid blanks can be made in such a way as to include two lids 8 that are joined side by side along their strips, respectively 21 and 22, and which can be separated by means of one or two perforated lines 26.

This last embodiment enables the simultaneous production of two cases side by side, which remain held together as a result of the two joined lids.

The advantages in the packing, storage, transport and wholesale sale of products in the above joined cases are obvious.

The joined cases can in fact be grouped together and packaged on pallets with the help, for example, of automatic machines, transported and sold wholesale with notable convenience due to the fact that during every handling stage one is always dealing with two cases, and thus a large number of products at a time.

The two cases can be conveniently separated for the retail sale of the related products contained within, by detaching the lids along the perforated line 15.

This makes it possible for the public to purchase packs containing a limited number of products, or to open only a single small size pack, with the consequent exposure of its contents to dust and atmospheric agents, for the loose sale of the products.

Furthermore, one benefits from the advantages of being able to either partially or totally remove one or both of the lids in this case too, displaying the contents within, independently of whether the cases have or have not been separated.

What is claimed is:

1. A perfected case for products of different kinds comprising: a base piece; two side pieces and two head pieces; two strengthening projections located along vertical edges of each of said head pieces, providing outer faces along the sides thereof; two end flaps, folding on upper ends of said head pieces, said flaps folded over said strengthening projections, providing top faces thereon; two tabs, holding said end flaps folded in place on the strengthening projections, said two tabs folding on either end of each end flap, which are in their turn folded down and glued to the outer face of each strengthening projection, facing towards the outside of the case; a lid to close said case, said lid being obtained from a single blank divided by two preformed transverse fold lines into a central area and two wings, said two wings articulated to said central area and located opposite each other, said wings having free ends cut to have an outline that corresponds and is complimentary to the shape of corresponding upper edges of said side pieces, two longitudinal perforated lines extending along free edges of said central area and of said wings, to delineate two strips, each strip divided by said transverse fold lines into three portions, one portion corresponding to said central area and two portions corresponding to said wings, said strips being designed to be completely glued to said outer faces and top faces with said free ends adjoining said upper edges of said side pieces, wherein after said lid has been fitted to the case, said central area and wings can be detached from said portions of said strips along said perforated lines, so that said wings and central area can be removed.

2. A case as in claim 1, wherein each of said portions corresponding to said central area has an additional tab, said additional tabs being designed to be folded downward for gluing to corresponding outer surfaces of said head pieces.

* * * * *